US005228483A

United States Patent [19]

Yuh et al.

[11] Patent Number: 5,228,483

[45] Date of Patent: Jul. 20, 1993

[54] MECHANISM FOR MANUFACTURING HANGERS

[76] Inventors: Ming-Shien Yuh; Ju-Chieng Yuh, both of No. 31-1, Lane 237, Sanming Rd., Changhua City, Taiwan

[21] Appl. No.: 889,515

[22] Filed: May 27, 1992

[51] Int. Cl.[5] ..... B21F 45/02

[52] U.S. Cl. ..... 140/81.5

[58] Field of Search ..... 140/80, 81, 81.5, 92, 140/101, 104, 115

[56] References Cited

U.S. PATENT DOCUMENTS 1,679,204 7/1928 Coney et al. ..... 140/81.5

2,093,173 9/1937 Olson et al. ..... 140/81.5

3,338,272 8/1967 Berg et al. ..... 140/115

*Primary Examiner*—Lowell A. Larson

*Attorney, Agent, or Firm*—Patterson & Keough

[57] ABSTRACT

A mechanism for forming a cylindrical portion of a hanger including a device for clamping the hanger, a gear threadedly engaged on a piston rod, a stub formed integral on the gear, a pair of holes formed in the stub for receiving the free end portions of the hanger, and device for rotating the gear in order to rotate the free end portions of the hanger, the gear moved longitudinally relative to the piston rod when the gear rotates, whereby, the free end portions of the hanger are wound in order to form the cylindrical portion.

11 Claims, 3 Drawing Sheets

MECHANISM FOR MANUFACTURING HANGERS

BACKGROUND OF THE INVENTION

1. Field of the Invention

The present invention relates to a mechanism, and more particularly to a mechanism for manufacturing coat hangers.

2. Description of the Prior Art

A typical coat hanger is wound from wire element comprising a body having a hook engaged thereon, in which a wound portion is formed between the body and the hook and is generally formed manually.

The present invention has arisen to provide a novel mechanism for forming the coat hangers.

SUMMARY OF THE INVENTION

The primary objective of the present invention is to provide a mechanism for manufacturing coat hangers.

In accordance with one aspect of the invention, there is provided a mechanism for forming a cylindrical portion of a hanger including means for clamping the hanger, the hanger being formed from a wire material including two free end portions, a first cylinder including a first piston rod having a free end portion, a gear threadedly engaged on the free end portion of the first piston rod and having a pair of holes formed therein for receiving the free end portions of the wire material for forming the hanger respectively, and means for rotating the gear in order to rotate and wind the free end portions of the wire material, the gear moved longitudinally relative to the first piston rod when the gear rotates, whereby, the free end portions of the wire material for forming the hanger are wound in order to form the cylindrical portion of the hanger.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 5:
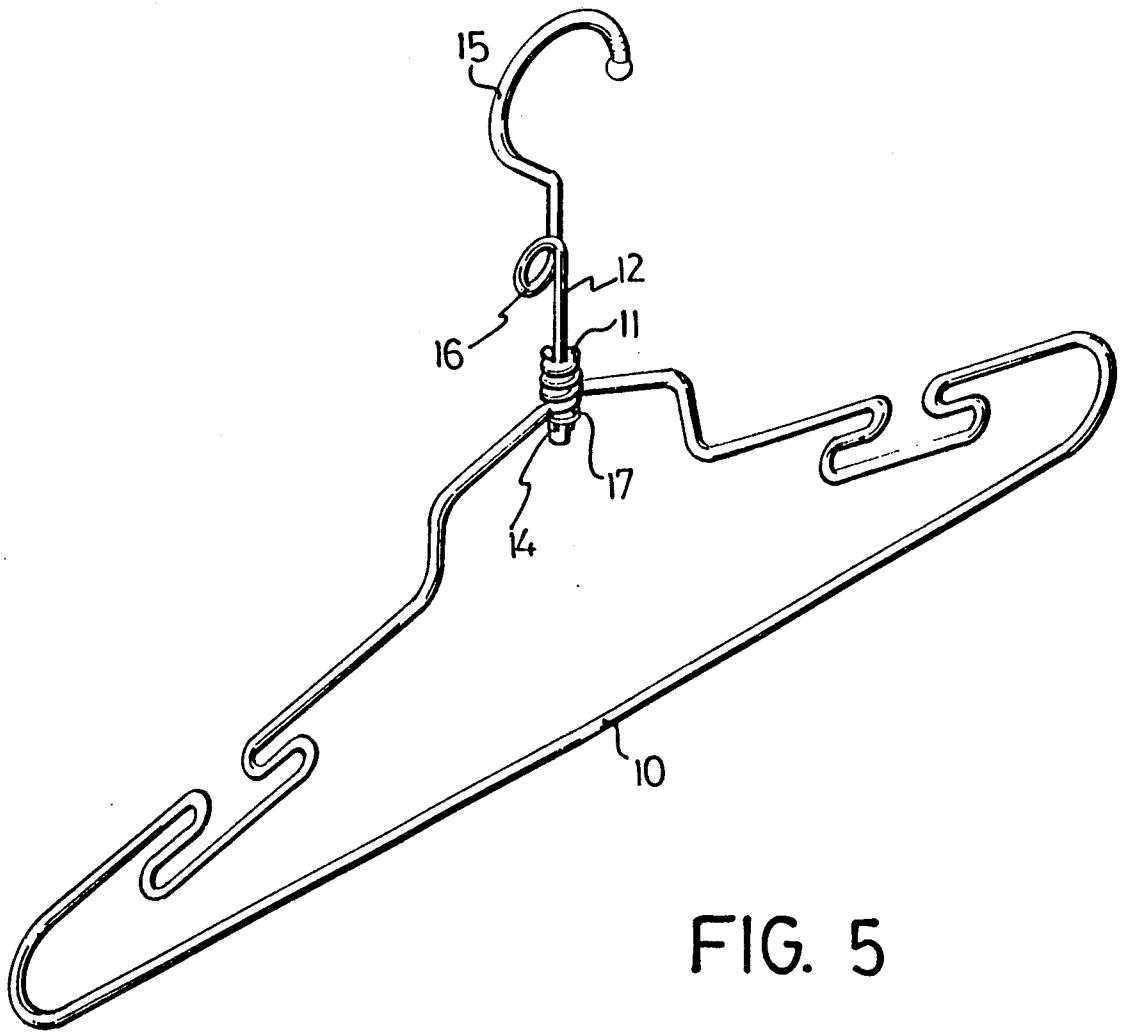
FIG. 5 is a top plane view of a typical hanger.

Referring to the drawings, and initially to FIG. 5, a typical hanger, such as a coat hanger includes a body 10 having a cylindrical portion 11 integrally formed thereon. The body 10 is wound from wire material and the cylindrical portion 11 is formed by the end portions of the wire material. A stem 12 includes a lower end extended through the cylindrical portion 11 and having a pair of stops 14 formed thereon such that the stem 12 can be prevented from disengagement from the cylindrical portion 11 and such that the stem 12 can be rotatably engaged in the cylindrical portion 11. A washer 17 is engaged between the cylindrical portion 11 and the stops 14. A hook 15 is integrally formed on the upper portion of the stem 12, and a loop portion 16 is formed in the middle portion of the stem 12 for limiting the downward movement of the stem 12 relative to the cylindrical portion 11.

Figure 1:
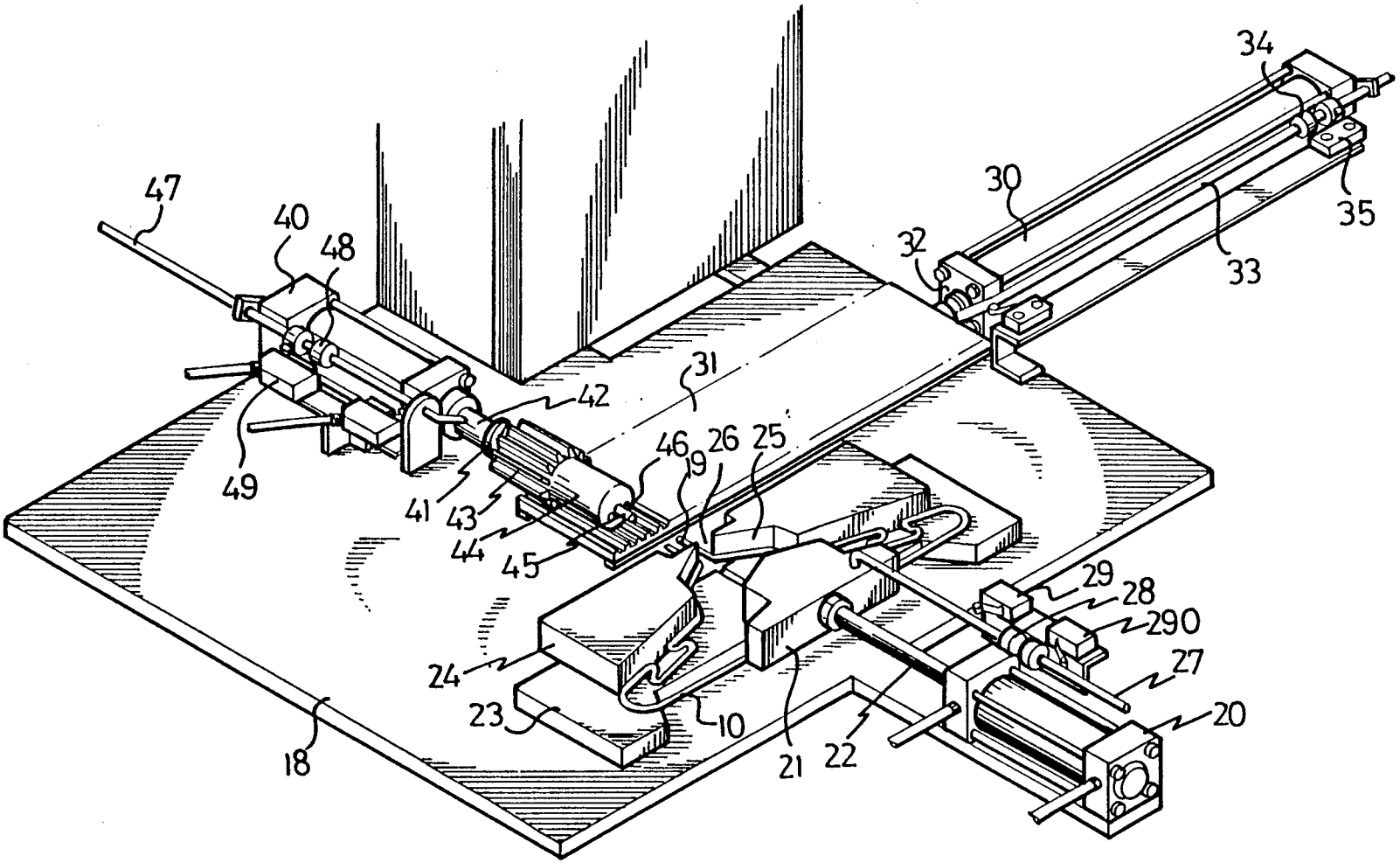
FIG. 1 is a perspective view of a mechanism for forming hangers in accordance with the present invention.

Referring next to FIG. 1, a mechanism in accordance with the present invention is provided to form the cylindrical portion 11 of the body 10 of the hanger and comprises generally three cylinders 20, 30, 40 disposed on a platform or a working table 18, in which the cylinders 20, 40 are aligned and the cylinder 30 is perpendicular to the cylinders 20, 40. A block 21 is fixed on the free end portion of the piston rod 22 of the cylinder 20. A plate 23 is disposed on the working table 18 in front of the cylinder 20, and a pair of mold pieces 24 are disposed on the plate 23 and each includes a mold cavity 25 formed therein, the mold cavities 25 have a shape corresponding to that of the block 21 and are arranged such that a middle portion of the body 10 can be retained and clamped between the mold pieces 24 and the block 21 when the block 21 is caused to move forward toward the mold pieces 24 by the cylinder 20. A gap 26 is formed between the two mold pieces 24, and the wire material for forming the body 10 has free end portions 19 extended through the ga 26 and extended toward the cylinder 40.

A post 27 has one end fixed on the board 21 and is parallel to the cylinder 20, at least one stop 28 is fixed on the post 27, and a pair of microswitches 29, 290 are disposed beside the post 27 for engagement with the stop 28 in order to control the forward and rearward movements of the post 27 respectively, for example, when the stop 28 contacts the microswitch 29, the piston rod 22 is caused to be retracted inwards of the cylinder 20, and when the stop 28 contacts the microswitch 290, the piston rod 22 is caused to extend outwards of the cylinder 20.

A rack 31 is fixed to the free end portion of the piston rod 32 of the cylinder 30 and extended to a position located between the two aligned cylinders 20, 40. The cylinder 30 also includes a post 33 having one end fixed to the the piston rod 32 and in parallel to the cylinder 30, at least one stop 34 is fixed on the post 33, and a pair of microswitches 35 are disposed beside the post 33 for engagement with the stop 34 in order to control the forward and rearward movement of the piston rod 32.

A threaded portion 41 is formed on the free end portion of the piston rod 42 of the cylinder 40, a gear 43 is threadedly engaged on the threaded portion 41 of the piston rod 42 and engaged with the rack 31. It is to be noted that the gear 43 and the rack 31 are engaged with each other whenever the gear 43 is caused to move forward and rearward by the cylinder 40. The gear 43 is caused to rotate when the rack 31 is caused to move either forward or rearward by the cylinder 30. It is to be noted that the gear 43 is caused to move longitudinally along the piston rod 42 by the threaded engagement between the gear 43 and the threaded portion 41 of the piston rod 42 when the gear 43 is rotated. A stub 44 is fixed on the gear 43 and extended toward the cylinder 20 and includes a pin 45 formed integral thereon and extended toward the cylinder 20 and includes a pair of holes 46 formed therein for receiving the free end portions 19 of the body 10 of the hanger to be formed.

The cylinder 40 also includes a post 47 having one end fixed to the the piston rod 42 and in parallel to the cylinder 40, at least one stop 48 is fixed on the post 47, and a pair of microswitches 49 are disposed beside the post 47 for engagement with the stop 48 in order to control the forward and rearward movement of the piston rod 42. The free end portions 19 of the body 10 are engaged in the holes 46 of the stub 44 when the stub 44 moves forward towards the cylinder 20, and the pin 45 is engaged between the end portions 19, best shown in FIG. 2.

Figure 2:
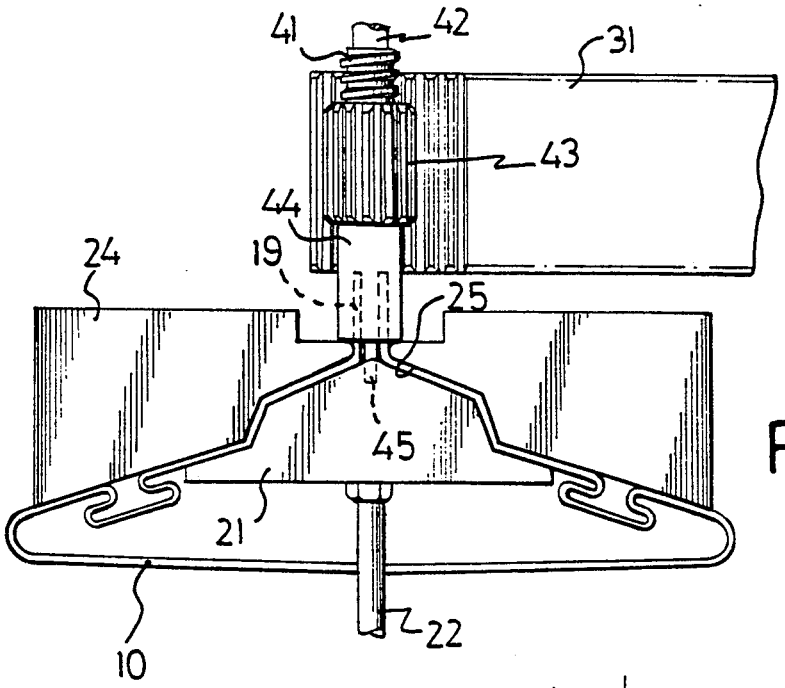
FIGS. 2, 3 and 4 are top schematic views illustrating the manufacturing processes of the mechanism.
Figure 3:
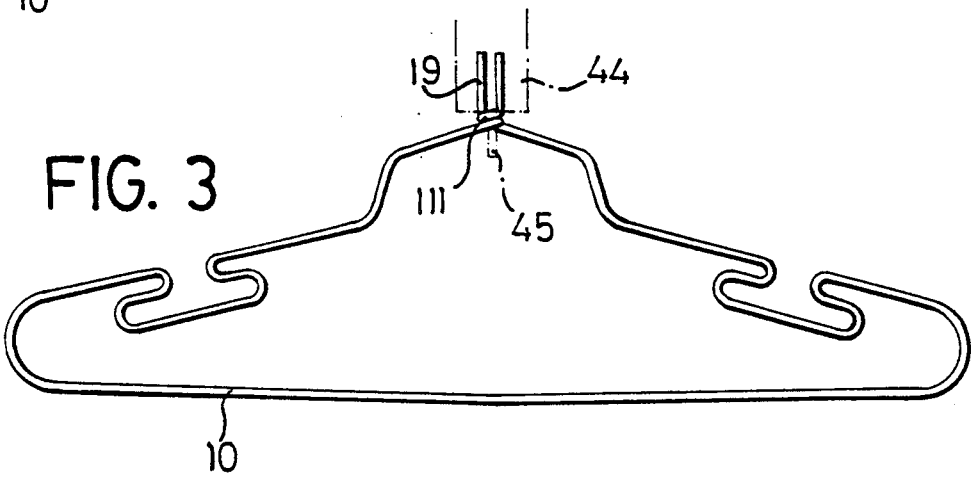
Figure 4:
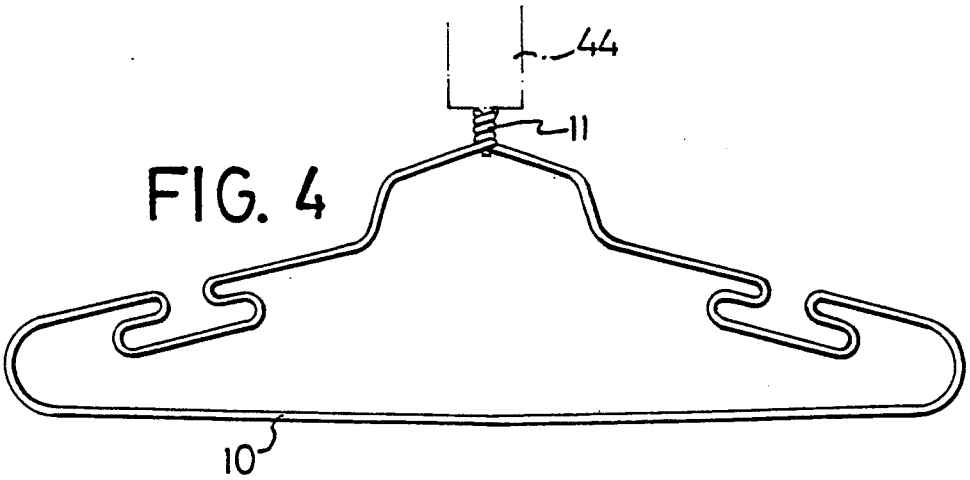

In manufacturing the cylindrical portion 11 of the body 10 of the hanger, referring next to FIGS. 2, 3 and 4, the free end portions 19 of the wire material for forming the body 10 of the hanger are engaged in the holes 46 of the stub 44, and the pin 45 is engaged between the free end portions 19 when the stub 44 is caused to move forward toward the mold pieces 24 by the cylinder 40, as shown in FIG. 2.

Then, the rack 31 is caused to move forward by the cylinder 30, such that the gear 43 and the stub 44 are rotated, and such that the free end portions 19 of the body 10 are wound around the pin 45, and such that a helically wound portion 111 is formed by the free end portions 19, as shown in FIG. 3.

It is to be noted that the stub 44 and the gear 43 are caused to move gradually backward along the piston rod 42 When the gear 43 rotates relative to the threaded portion 41 of the piston rod 42, such that the wound portion 111 can be formed. The rearward moving rate or speed of stub 44 is equal or corresponds to the rate of formation of the wound portion 111. Continuous rotation of the gear 43 causes the stub 44 to move away from the mold pieces 24, such that the cylindrical portion 11 of the body 10 can be formed, as shown in FIG. 4.

Alternatively, the threaded engagement between the threaded portion 41 and the gear 43 can be arranged such that the gear 43 moves rearward when the rack 31 is pulled backward by the cylinder 30.

Further alternatively, without the stub 44, the holes 46 can be formed directly in the gear 43 and the pin 45 can be directly and integrally formed on the gear 43.

Accordingly, the helically wound portion 111 or the cylindrical portion 11 of the hanger can be easily formed by the mechanism in accordance with the present invention.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A mechanism for forming a cylindrical portion of a hanger comprising:

means for clamping said hanger, said hanger being formed from a wire material including two free end portions, a first cylinder including a first piston rod having a free end portion, a gear threadedly engaged on said free end portion of said first piston rod and having a pair of holes formed therein for receiving said free end portions of said wire material for forming said hanger respectively, and means for rotating said gear in order to rotate and wind said free end portions of said wire material, said gear moved longitudinally relative to said first piston rod when said gear rotates, whereby, said free end portions of said wire material for forming said hanger are wound in order to form said cylindrical portion of said hanger.

2. A mechanism according to claim 1, wherein said means for clamping said hanger comprises a pair of mold pieces each having a mold cavity formed therein, said mold cavities of said mold pieces having a shape corresponding to that of said hanger, said mold pieces including a gap formed therebetween, said free end portions of said wire material extended through said gap formed between said mold pieces, a second cylinder including a second piston rod, a block fixed on said second piston rod and caused to move toward said mold pieces for engagement with said mold cavities in order to clamp said hanger.

3. A mechanism according to claim 2, wherein said second cylinder includes a post disposed in parallel to said second piston rod and having one end fixed to said block, a stop fixed on said post, and a pair of microswitches disposed beside said post for engagement with said stop in order to control forward and rearward movements of said second piston rod.

4. A mechanism according to claim 1, wherein said first cylinder includes a post disposed in parallel to said first piston rod and having one end fixed to said piston rod, a stop fixed on said post, and a pair of microswitches disposed beside said post for engagement with said stop in order to control forward and rearward movements of said first piston rod.

5. A mechanism according to claim 1, wherein said means for rotating said gear comprises a second cylinder including a second piston rod, and a rack fixed to said second piston rod and engaged with said gear, said rack is moved by said second piston rod in order to rotate said gear.

6. A mechanism according to claim 5, wherein said second cylinder includes a post disposed in parallel to said second piston rod and having one end fixed to said block, a stop fixed on said post, and a pair of microswitches disposed beside said post for engagement with said stop in order to control forward and rearward movements of said second piston rod.

7. A mechanism according to claim 1, wherein said gear includes a pin integrally fixed thereon and engaged between said free end portions of said wire material when said gear moves toward said free end portion of said wire material.

8. A mechanism for forming a cylindrical portion of a hanger comprising:

means for clamping said hanger, said hanger being formed from a wire material including two free end portions, a first cylinder including a first piston rod having a free end portion, a gear threadedly engaged on said free end portion of said first piston rod and having a pair of holes formed therein for receiving said free end portions of said wire material for forming said hanger respectively, and a pin formed integral on said gear and engaged between said free end portions of said wire material when said gear moves toward said free end portion of said wire material, means for rotating said gear in order to rotate and wind said free end portions of said wire material, said gear moved longitudinally relative to said first piston rod when said gear rotates, whereby, said free end portions of said wire material for forming said hanger are wound in order to form said cylindrical portion of said hanger.

9. A mechanism for forming a cylindrical portion of a hanger comprising:

means for clamping said hanger, said hanger being formed from a wire material including two free end portions, a first cylinder including a first piston rod having a free end portion, a gear threadedly engaged on said free end portion of said first piston rod, a stub formed integral on said gear and having a pair of holes formed therein for receiving said free end portions of said wire material for forming said hanger respectively, and a pin formed integral on said stub and engaged between said free end portions of said wire material when said gear moves toward said free end portion of said wire material, means for rotating said gear in order to rotate and wind said free end portions of said wire material, said gear moved longitudinally relative to said first piston rod when said gear rotates, whereby, said free end portions of said wire material for forming said hanger are wound in order to form said cylindrical portion of said hanger.

10. A mechanism according to claim 9, wherein said means for clamping said hanger comprises a pair of mold pieces each having a mold cavity formed therein, said mold cavities of said mold pieces having a shape corresponding to that of said hanger, said mold pieces including a gap formed therebetween, said free end portions of said wire material extended through said gap formed between said mold pieces, a second cylinder including a second piston rod, a block fixed on said second piston rod and caused to move toward said mold pieces for engagement with said mold cavities in order to clamp said hanger.

11. A mechanism according to claim 9, wherein said means for rotating said gear comprises a second cylinder including a second piston rod, and a rack fixed to said second piston rod and engaged with said gear, said rack is moved by said second piston rod in order to rotate said gear.

* * * * *